US008007249B2

(12) United States Patent
Spargo

(10) Patent No.: US 8,007,249 B2
(45) Date of Patent: Aug. 30, 2011

(54) TILE FLOOD PUMP

(76) Inventor: Rick D. Spargo, Hoxie, AR (US)

( * ) Notice: Subject to any disclaimer, the term of this patent is extended or adjusted under 35 U.S.C. 154(b) by 1105 days.

(21) Appl. No.: 11/820,637

(22) Filed: Jun. 20, 2007

(65) Prior Publication Data

US 2008/0317606 A1 Dec. 25, 2008

(51) Int. Cl.
*F04B 17/06* (2006.01)

(52) U.S. Cl. ..... 417/231; 417/300

(58) Field of Classification Search ..... 417/231, 417/234, 300, 313, 423.19
See application file for complete search history.

(56) References Cited

U.S. PATENT DOCUMENTS 2,799,229 A * 7/1957 Ogles et al. ..... 415/121.3
2,962,866 A 12/1960 Muehlfeld ..... 61/10
3,008,422 A * 11/1961 Crisafulli ..... 417/234
3,832,093 A 8/1974 Shirek et al. ..... 417/231
3,905,725 A * 9/1975 Johnson ..... 417/231
4,175,916 A * 11/1979 Crisafulli ..... 417/231
4,594,006 A * 6/1986 Depeault ..... 366/266
5,364,233 A * 11/1994 Benoit ..... 417/231
5,624,241 A * 4/1997 Nesseth ..... 417/234
6,988,874 B2 * 1/2006 Spargo ..... 417/234
2002/0187054 A1 * 12/2002 Eller et al. ..... 417/234

* cited by examiner

*Primary Examiner* — Charles Freay
*Assistant Examiner* — Patrick Hamo
(74) *Attorney, Agent, or Firm* — John M Harrison

(57) ABSTRACT

A tile flood pump for attachment to a tile or drain pipe and pumping water from a field. The pump includes a pump housing, a flange bolted to the tile and an impeller housing enclosing one or more, lower rotating impellers, and extending into the pump housing for pumping water from the field through the impeller housing and the tile. A flapper valve can be provided on the intake end of the pump housing to facilitate flow of water through the pump housing and the tile. A shaft housing extends into the pump housing for enclosing a drive shaft that mounts the lower impeller(s) and connects to an external drive system. A shaft housing extension is removably fitted into the shaft housing for enclosing an upper impeller to flood and cool the upper marine and load bearings which carry the impeller shaft, upon which the upper impeller is mounted.

6 Claims, 6 Drawing Sheets

TILE FLOOD PUMP

CROSS-REFERENCE TO RELATED APPLICATIONS

This application is related to my U.S. Pat. No. 6,988,874, which issued on Jan. 24, 2006.

BACKGROUND OF THE INVENTION

SUMMARY OF THE INVENTION

This invention relates to pumping devices for pumping water from flooded fields to drainage ditches, catch basins and canals. More particularly, the invention relates to a portable or fixed tile flood pump that can be quickly and efficiently moved, installed and operated in a selected location by the power take-off from a tractor or directly from a diesel, gasoline-powered or electric motor drive mechanism. The pump includes a typically horizontally-mounted pump housing which is flanged or otherwise attached to an existing tile or drain pipe extending through a dam, levee or dike from the field to the drainage ditch. An impeller housing joins the pump housing in angular relationship and is immersed in the water covering the field. The impeller housing is typically provided with flanges for enclosing, adding and/or replacing one or more lower impellers, fixed to an impeller shaft, to pump the water from the field through the impeller housing and the pump housing and through the existing tile or drain pipe, into the drainage ditch. A shaft housing joins the pump housing in angular relationship and is disposed in linear alignment with the impeller housing and typically includes an upper load bearing, a shaft housing extension flanged to the pump housing and upper marine bearings or bushings for stabilizing one end of the rotating shaft. The shaft extends through a lower marine bearing and a lower load bearing or bushing located in the impeller housing, for stabilizing the shaft. An upper impeller or impellers is fitted on the upper segment of the shaft, which extends through the shaft housing and housing extension and serves to flood and cool the upper marine bearings and load bearing which stabilize the upper end of the shaft. The shaft may be made up in two or more connected segments and is typically driven by a tractor power take-off or other drive mechanism such as a gasoline or diesel engine or an electric motor, to rotate the upper and lower impellers, each of which typically consists of two or more flights or screws fixedly mounted on a shaft coupler or on the shaft itself, for pumping the water from the field to the drainage ditch and through the shaft housing and shaft housing extension.

BRIEF DESCRIPTION OF THE DRAWINGS

The invention will be better understood by reference to the accompanying drawings, wherein.

DESCRIPTION OF THE PREFERRED EMBODIMENTS

Figure 1:
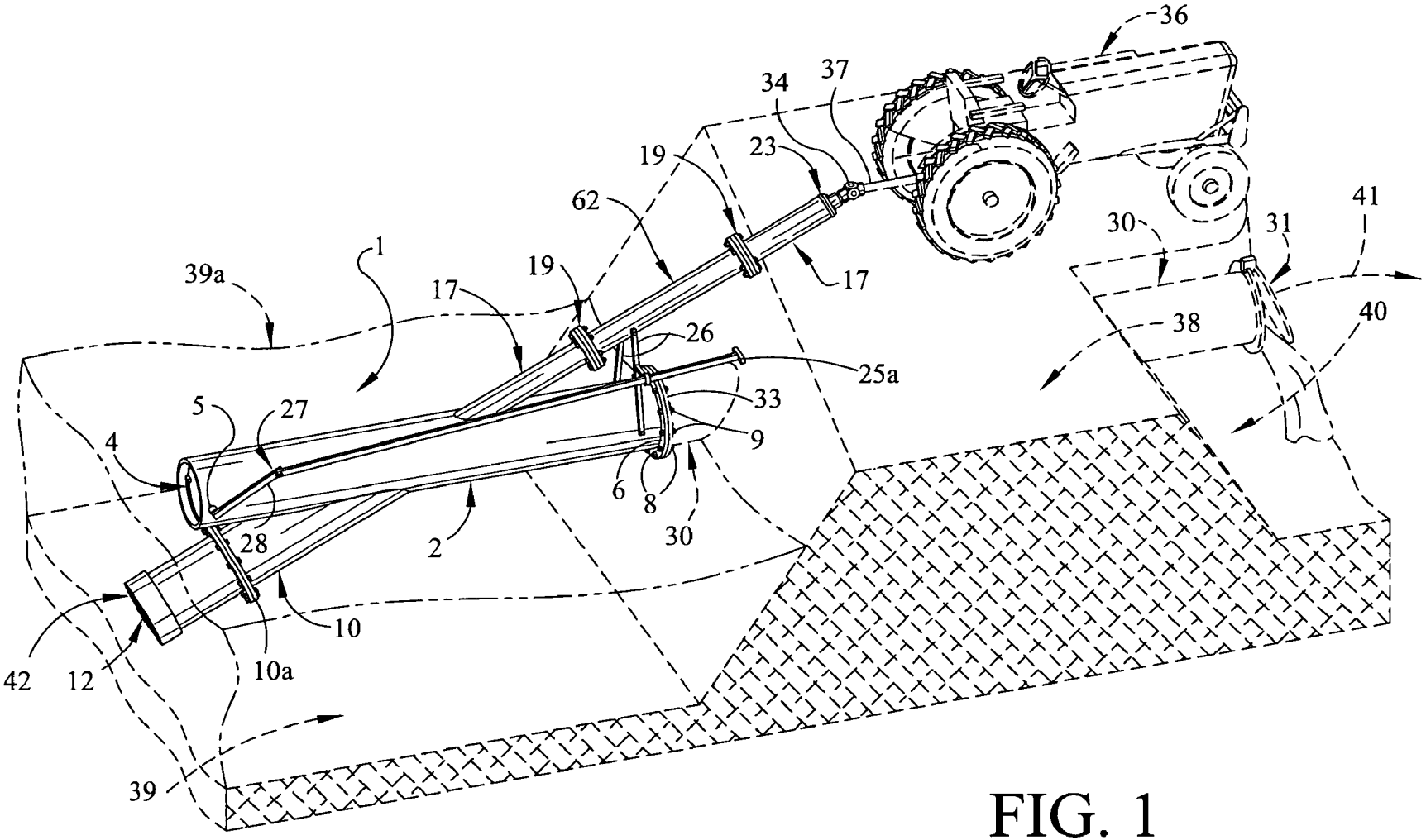
FIG. 1 is a perspective view of a typical installation of the tile flood pump, illustrating an existing permanent tile or drainage pipe buried in a levee or dike separating a flooded field from a drainage ditch, with the tile flood pump of this invention disposed on the field side of the levee and flanged to the tile or drainage pipe and driven by the power take-off shaft of a tractor.
Figure 3:
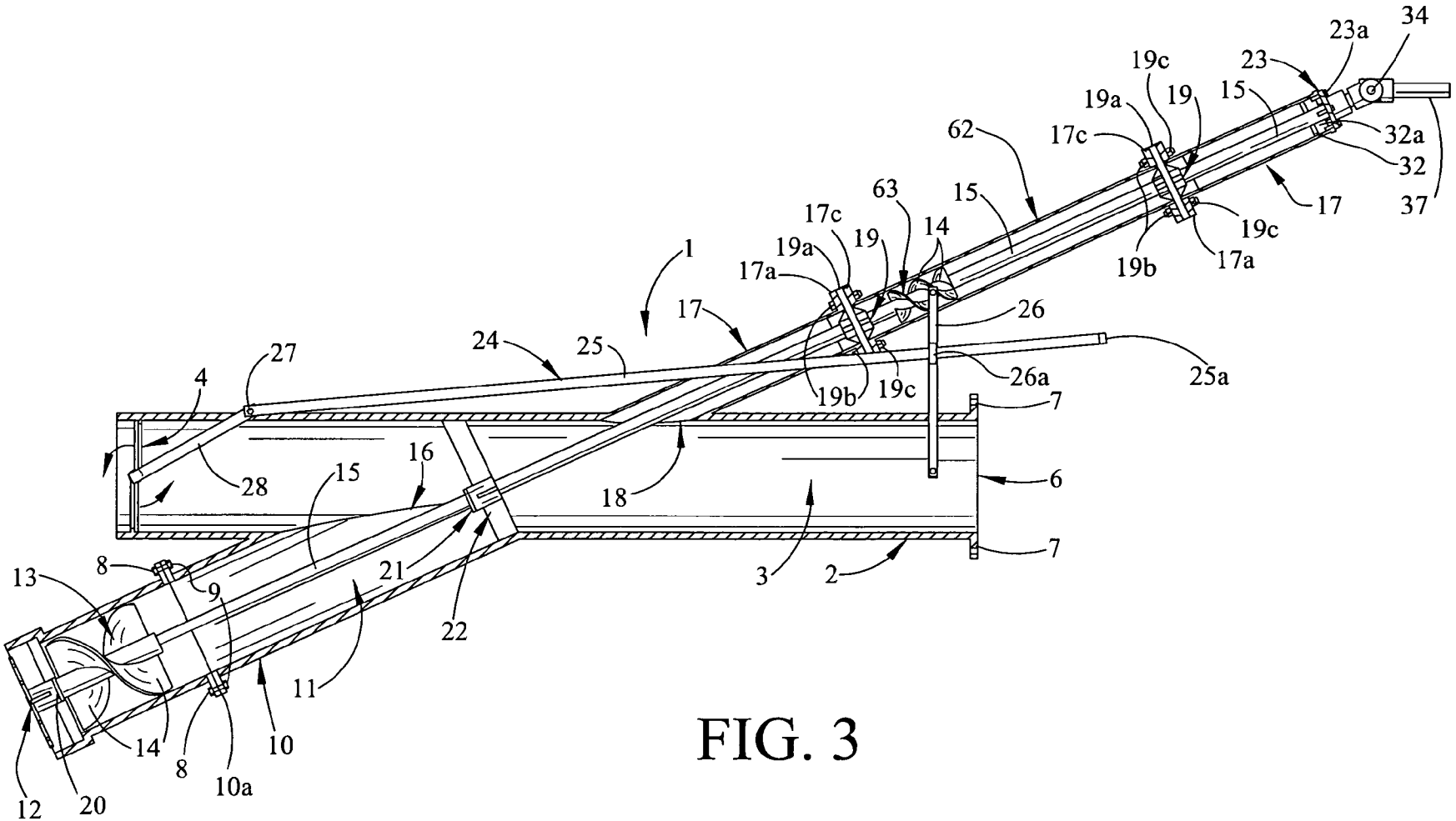
FIG. 3 is a perspective view, partially in section, of the tile flood pump illustrated in FIGS. 1 and 2, illustrating the intake end of the pump housing and an optional flapper valve and valve control, along with the intake end of the impeller housing, the lower or bottom impeller, the shaft housing and the shaft housing extension, as well as the upper or top impeller in the shaft housing extension.

Referring initially to FIGS. 1 and 3 of the drawings, a typical embodiment of the tile flood pump of this invention is generally illustrated as reference numeral 1. The tile flood pump 1 is illustrated in functional position attached to the field end of an existing tile or drain pipe 30, embedded substantially horizontally in a levee or dike 38, with the discharge end of the tile 30 extending over a drainage ditch 40 and typically fitted with a tile pivoting or flapper valve 31, (all illustrated in phantom) the flapper valve 31 preventing water from backing up from the drainage ditch 40, through the tile 30 and back into the field 39. The tile flood pump 1 is oriented such that the cylindrical pump housing 2 is substantially horizontally disposed and is typically flanged to the tile flange 33 on the intake end of the tile 30, at the field 39. An impeller housing 10 extends in angular relationship downwardly and outwardly from a pump housing 2 and typically terminates in an intake grid 12, which serves as a water inflow or intake 42, as indicated by the arrow in FIG. 1. Accordingly, water is typically pumped from the field 39 as indicated by the water inflow or intake arrow 42, through the intake grid 12, into the impeller housing 10 and through the pump housing 2 and from the discharge end of the tile 30 at the flapper valve 31, into the drainage ditch 40, as further illustrated in FIG. 3.

Figure 4:
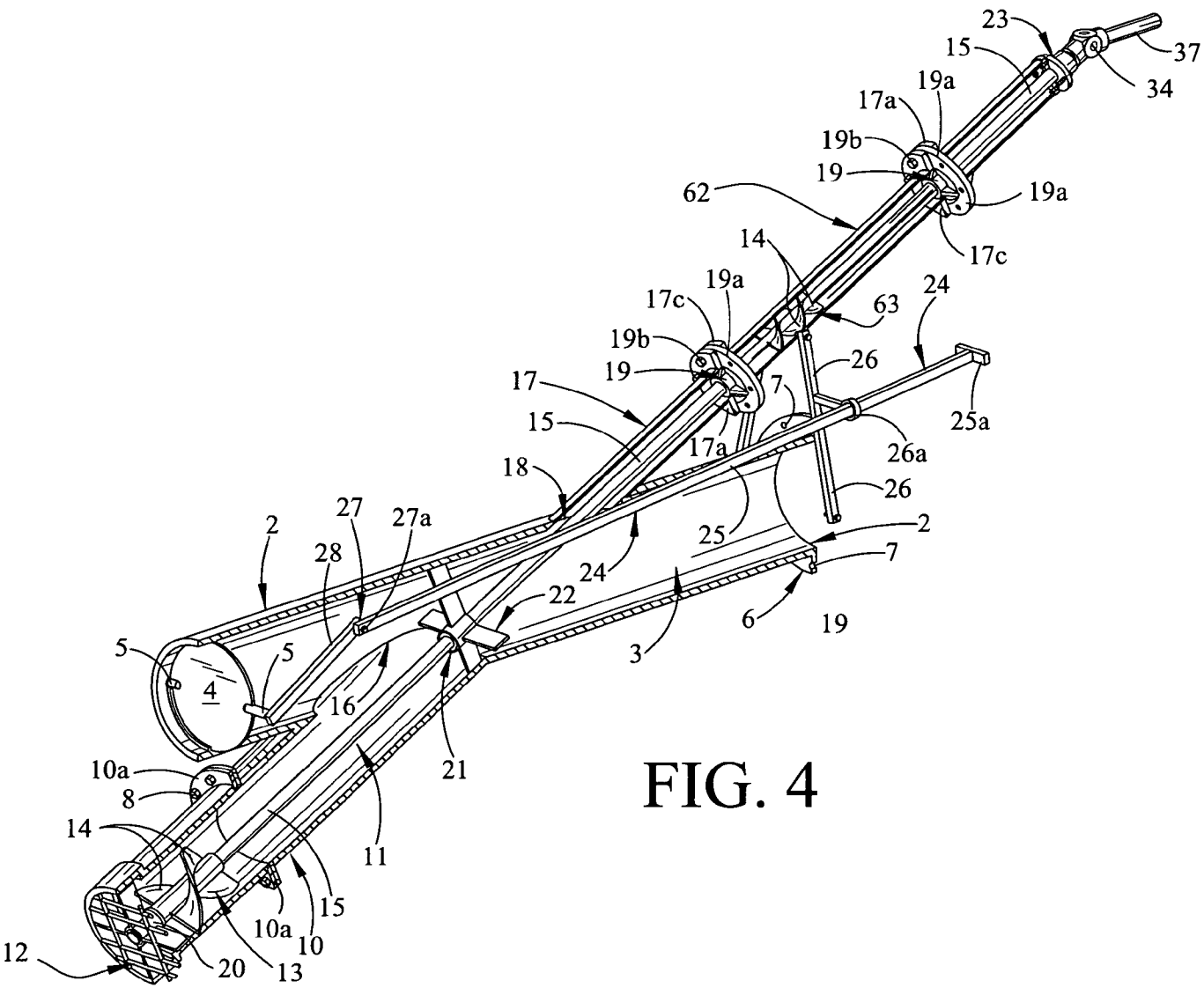
FIG. 4 is a front perspective view of the pump housing, shaft housing, shaft housing extension, impeller housing and top and bottom impellers of the tile flood pump illustrated in FIG. 2, more particularly illustrating a typical power drive coupling to the impeller shaft in the shaft housing.

In a typical embodiment of the invention, a tractor 36, fitted with a power take-off 37, is oriented on the levee 38 (all illustrated in phantom) such that the power take-off 37 can be connected to the impeller shaft 15, illustrated in FIGS. 3 and 4, of the tile flood pump 1, through a universal joint 34, to operate the power take-off 37 and rotate the impeller shaft 15 and the internal lower impeller or impellers 13 and pump water from the field 39 to the drainage ditch 40, as hereinafter further described. The tile flood pump 1 may be portable and can be transported to the field 39 on a trailer (not illustrated), typically pulled by the tractor 36.

Figure 2:
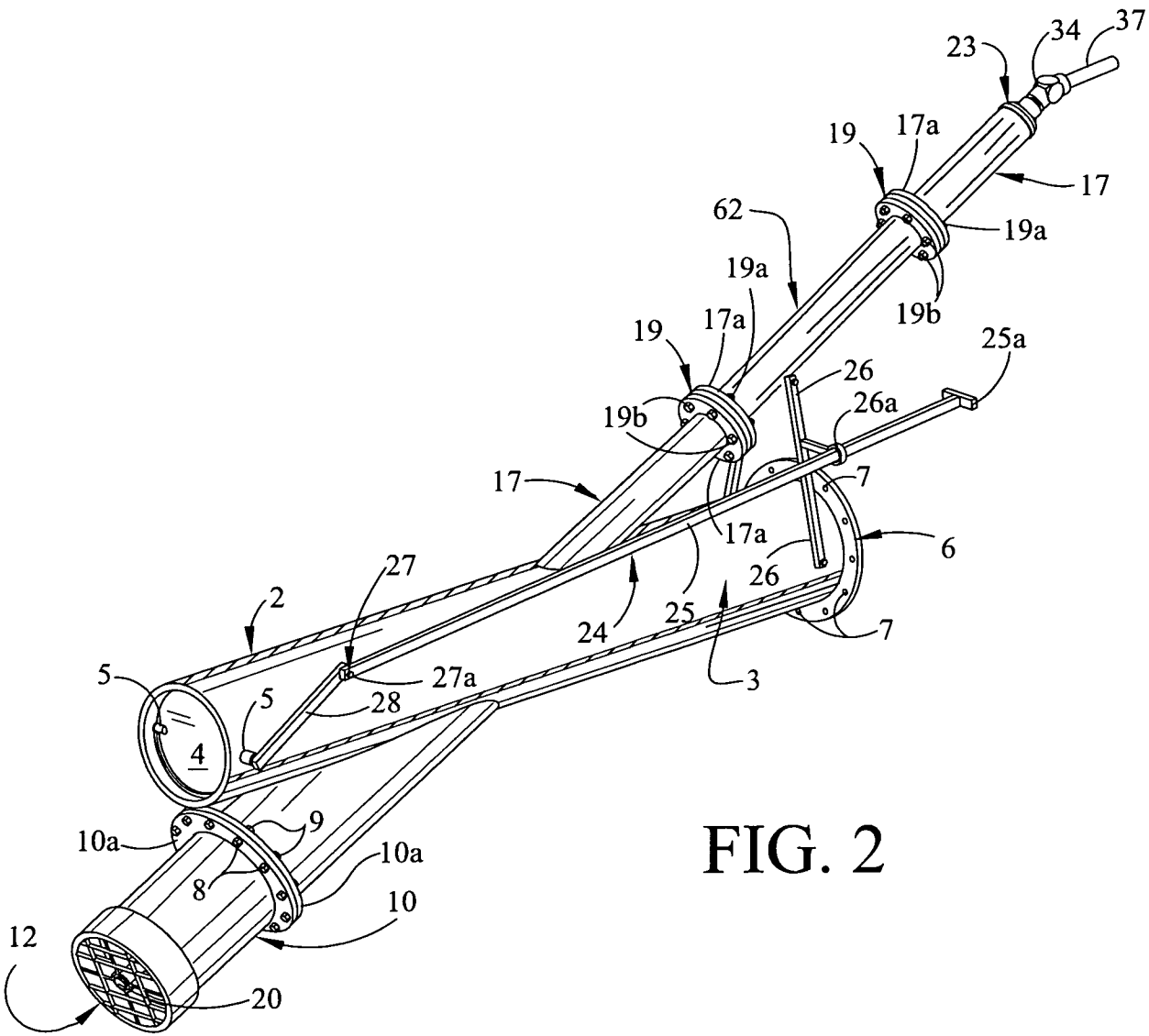
FIG. 2 is a front perspective view of the tile flood pump illustrated in FIG. 1, more particularly illustrating the pump housing, shaft housing, flanged shaft housing extension and impeller housing.

Referring now to FIGS. 2-5 of the drawings, the tile flood pump 1 illustrated in FIGS. 1 and 2 is typically characterized by a cylindrical pump housing 2 of selected length and diameter, having a pump housing bore 3 (FIGS. 3-5) of corresponding size. An optional pump housing pivoting or flapper valve 4 may be pivoted to the intake end of the pump housing 2 by a flapper valve pin or pins 5 (FIGS. 2 and 4) for controlling the flow of water through the pump housing 2. This flow control is typically effected by a flapper valve control 24 that includes a flapper valve control rod 25, slidably extending through a brace ring 26*a*, mounted to a corresponding control handle braces 26, which are attached to a shaft housing 17. The flapper valve control rod 25 is pivotally connected at the extending end to a flapper valve connecting rod 28 by a control handle pivot pin 27*a*, at a control handle pivot 27. The flapper valve connecting rod 28 is also attached to a flapper valve pin 5 of the pump housing flapper valve 4, such that the flapper valve control rod 25 can be grasped at the control rod grip 25*a* and pulled, to open the pump housing flapper valve 4. In like manner, the flapper valve control rod 25 can be pushed to close the pump housing flapper valve 4 and prevent water from flowing by gravity through the pump housing 2 and the tile 30, from the field 39 to the drainage ditch 40. Alternatively, in some installations the pump housing flapper valve 4 can be replaced by a cap or seal to close the distal end of the pump housing 2 and eliminate the need for the flapper valve control 24.

Figure 5:
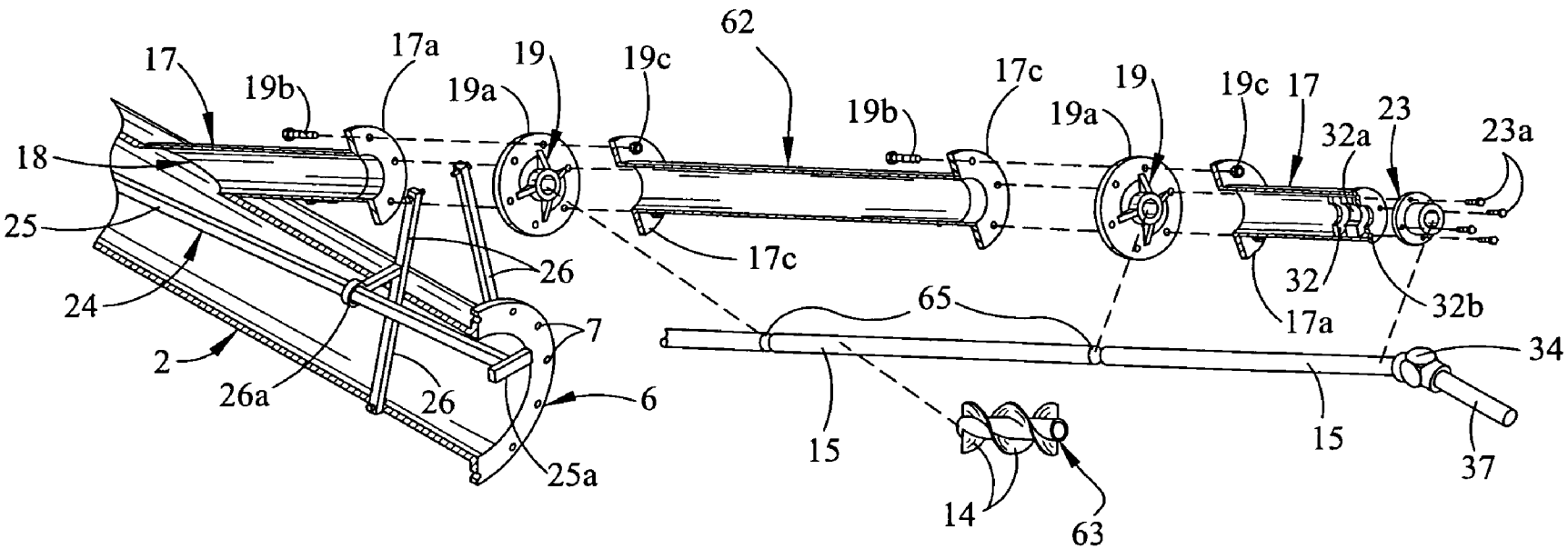
FIG. 5 is a partial sectional view of the pump housing and an exploded view of the shaft housing and shaft housing extension elements of the tile flood pump illustrated in FIG. 3, more particularly illustrating the upper impeller and shaft bearing components.

As further illustrated in FIGS. 1-5 of the drawings, the cylindrical shaft housing 17 joins the pump housing 2 in angular relationship at a shaft housing opening 18 (FIGS. 3-5) and the shaft housing 17 is aligned with the impeller housing 10, which joins the pump housing 2 at the impeller housing discharge opening 16 (FIGS. 3 and 4). Accordingly, it will be appreciated from a consideration of the drawings that the shaft housing 17 and the impeller housing 10 are linearly aligned with each other to accommodate the impeller shaft 15, the upper end of which extends through a pair of upper flange bearings 19, mounted in corresponding bearing flanges 19*a*, secured to facing shaft housing flanges 17*a* and shaft housing extension flanges 17*c* (FIGS. 2-5) by bearing flange bolts 19*b* and nuts 19*c*, near the top end of the shaft housing 17. Accordingly, the impeller shaft 15 extends through a removable shaft housing extension 62, fitted with the housing extension flanges 17*c*, that mount on the facing shaft housing flanges 17*a*, respectively. The impeller shaft 15 extends to an upper load bearing 23, mounted on the top end of the shaft housing 17 by means of bearing mount bolts 23*a*, and also extends through a spacer plate 32, to the universal joint 34. The impeller shaft 15 also projects downwardly through the shaft housing 17 and the pump housing 2, where the extending end thereof terminates inside the impeller housing 10 in a lower load bearing 20 (FIGS. 3 and 4). A lower impeller 13 is rigidly attached by a key or by any other convenient technique to the impeller shaft 15 in the impeller housing bore 11, near the intake end of the impeller housing 10 and the intake grid 12, and typically includes one or more impeller flights 14, which rotate with the impeller shaft 15 and operate to pump water through the intake grid 12, located on the extending end of the impeller housing 10, as it is immersed in the flooded field 39. An upper impeller 63, having a selected number of impeller flights 14, is mounted on that segment of the impeller shaft 15 which projects through the shaft housing extension 62. Water is thus pumped through the intake grid 12, the impeller housing 10, the pump housing 2, and through the tile 30, into the drainage ditch 40, by rotation of the impeller shaft 15 and the lower impeller 13, as illustrated in FIGS. 1-3. Water is also pumped through the shaft housing 17 and the shaft housing extension 62 by rotation of both the lower impeller 13 and the upper impeller 63. In a typical embodiment, the impeller shaft 15 is stabilized inside the impeller housing 10 by a marine bearing 21, mounted inside the pump housing 2 by means of marine bearing mounts 22, typically deployed as illustrated in FIG. 4. Additional spaced-apart upper marine bearings 19 are fitted to the impeller shaft 15, typically in the spaced-apart bearing flanges 19*a*, engaging corresponding bearing flange grooves or seats 65 (FIG. 5), at each end of the shaft housing extension 62. The upper impeller 63 is typically keyed or otherwise fixed to the impeller shaft 15 between the upper marine bearings 19 (FIGS. 3-5). While a single impeller shaft 15 may be used in the tile flood pump 1, two linearly-connected shaft segments may also be implemented, one of which typically fits in the shaft housing extension 62 and the other extending downwardly through the shaft housing 17, the pump housing 2 and the impeller housing 10.

The control handle braces 26 of the flapper valve control 24 extend from fixed attachment to the shaft housing 17, to welded or otherwise fixed attachment to the pump housing 2, for securing the shaft housing 17 to the pump housing 2 in alignment with the impeller housing 10 and stabilizing the flapper valve control rod 25 by means of the brace ring 26*a*. As further illustrated in FIGS. 3 and 5, a spacer plate 32 is typically spaced-apart from the upper load bearing 23 in the upper end of the shaft housing 17 and a weep space 32*a* is provided in the spacer plate 32. A weep hole or slot 32*b* is also provided in the shaft housing 17, between the spacer plate 32 and the load bearing 23 (FIG. 5) and allows water forced upwardly into the shaft housing 17 to seep along the impeller shaft 15, past the spacer plate 32 at the weep space 32*a* and from the shaft housing 17 at the weep slot 32*b*, to indicate the pumping efficiency of the tile flood pump 1 and monitor the cooling effect on the upper marine bearings 19 and upper load bearing 23, primarily by operation of the upper impeller 63.

Referring again to FIGS. 1 and 4 of the drawings, as heretofore described, in a typical embodiment of the invention the pump housing flapper valve 4 is pivotally secured to the intake end of the pump housing 2 by means of a flapper valve pin or pins 5, that extend through the end of the pump housing 2, into or across a diameter thereof, to engage the pump housing flapper valve 4 and facilitate opening and closing of the pump housing flapper valve 4 responsive to slidable manipulation of the flapper valve control 24. Furthermore, the pump housing 2 may be fitted with a pump housing flange 6, having pump housing flange openings 7 (FIG. 2), for securing the pump housing 2 to the tile flange 33 on the flanged intake end of the tile 30, as illustrated in FIG. 1. Flange bolts 8 and flange bolt nuts 9 illustrated in FIG. 1 serve to removably connect the pump housing flange 6 of the pump housing 2 to the tile flange 33 on the flanged intake end of the tile 30. The impeller housing flanges 10*a* are provided on the lower end of the impeller housing 10 and are secured by additional flange bolts 8 and flange bolt nuts 9, to facilitate replacing the lower impeller 13 or adding one or more impellers to the lower end of the impeller shaft 15 in the impeller housing 10, as desired.

Figures 6, 7, 8:
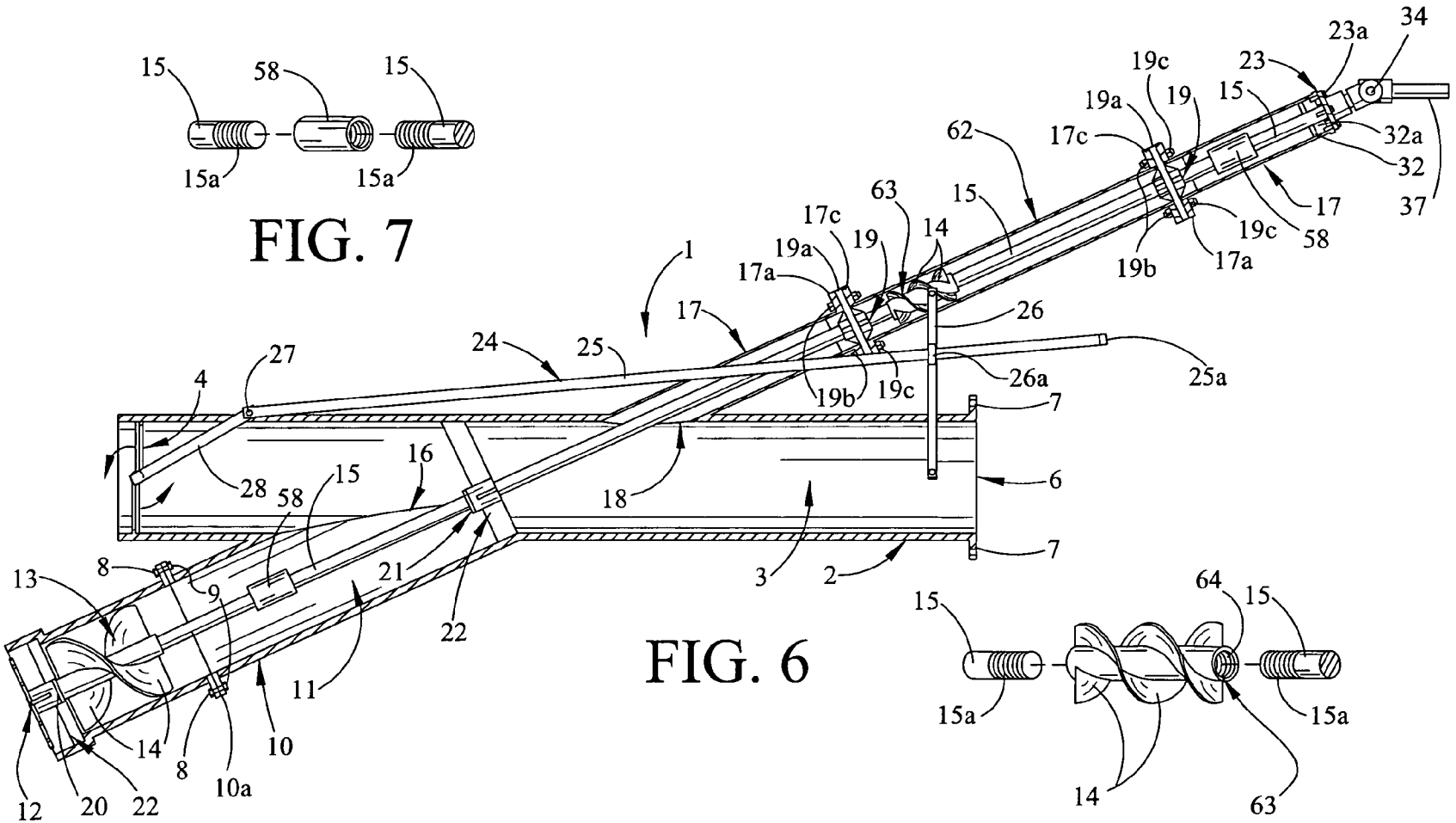
FIG. 6 is a sectional view of an alternative embodiment of the tile flood pump wherein the impeller shaft is segmented and connected by shaft couplers.
FIG. 7 is a perspective view of a typical shaft coupler for joining a pair of shaft segments.
FIG. 8 is a typical impeller and shaft segment design for connecting the upper and lower impellers to the respective impeller shaft segments.

As illustrated in FIGS. 6-8 of the drawings the impeller shaft 15 can be made up of multiple shaft segments, each fitted with shaft threads 15*a* for connection by shaft couplers 58 (FIG. 7). The shaft threads 58 may also be threaded into internal impeller threads 64 (FIG. 8) to join the lower impeller 13 and upper impeller 63 to the shaft 15. A pair of marine bearing mounts 22 are provided in the impeller housing bore 11 of the impeller housing 10 and serve to seat a marine bearing 21 and a lower load bearing or marine bearing 20, respectively, as illustrated in FIG. 6.

In operation, and referring again to the drawings, the tile flood pump 1 is typically portable and can be transported by means of a tractor 36 and trailer (not illustrated) or a pickup truck or other vehicle to and from a location where a tile 30 is embedded in a levee 38 for draining a field 39 (FIG. 1) during high water or flood conditions. Accordingly, the tile flood pump 1 can be transported to the desired location, lowered into the flooded field 39 and secured to the flanged intake end of the existing tile 30, by connecting the tile flange 33 of the tile 30 to the corresponding pump housing flange 6 of the pump housing 2, using the flange bolts 8 and flange bolt nuts 9, as illustrated in FIG. 1. When the tile flood pump 1 is in the position illustrated in FIG. 1 connected to the tile 30, if provided on the tile flood pump 1, the pump housing flapper valve 4 illustrated in FIGS. 1, 5 and 7 can be opened by grasping the control rod grip 25*a* of the flapper valve control rod 25 and pulling the flapper valve control rod 25, which action exerts pressure on the flapper rod connecting rod 28 at the control handle pivot pin 27*a* and causes the pump housing flapper valve 4 to pivot into the open position on the flapper valve pin 5. The tractor 36 or alternative power supply unit can then be operated to rotate the power take-off 37, which rotates the impeller shaft 15 and the lower impeller or impellers 13 inside the impeller housing 10, and causes water to flow through the intake grid 12, as indicated by the water inflow arrows 42 illustrated in FIG. 1. Accordingly, the water is caused to flow from the field 39, through the impeller housing 10 and the pump housing 2 by rotation of the impeller flights 14 on the lower impeller(s) 13. The water is further caused to flow upwardly, through the shaft housing 17, the shaft housing extension 62 and the upper marine bearings 19, to the upper load bearing 23 by rotation of both the lower impeller 13 and upper impeller 63, the latter of which acts as a booster pump, to force water entering the shaft housing 17 by rotation of the lower impeller 13, farther upwardly. The water also typically flows from the pump housing 2 through the tile 30 and from the tile 30 at the tile flapper valve 31, as indicated by the water discharge 41, into the drainage ditch 40, illustrated in FIG. 1. This pumping action forces the tile flapper valve 31 to pivot into the open configuration and pumping may continue until the water level in the field 39 is sufficiently low to minimize the damage to crops or other adverse conditions resulting from high water in the field 39, at which time the power to the power take-off 37 is terminated. Operation of the tile flood pump 1 is then stopped and the control rod grip 25*a* is grasped to push the flapper valve control rod 25 toward the field 39, along with the flapper valve connecting rod 28 and pivot the pump housing flapper valve 4 on the flapper valve pin 5, to close the pump housing flapper valve 4, if reverse gravity drain of water from the drainage ditch 40, through the pump housing 2 and the tile 30, back into the field 39 is undesirable. This action thus prevents water from flowing through the pump housing 2 by gravity and into or from the tile 30 into or from the drainage ditch 40. Alternatively, if additional gravity drainage from the field 39 to the drainage ditch 40 is desired without pumping action, when the water level in field 39 is above that in the drainage ditch 40, the pump housing flapper valve 4 may be pivoted to the open position as described above, to facilitate gravity drainage of the water into the drainage ditch 40, without the necessity of operating the tile flood pump 1. However, under circumstances where the water in the drainage ditch 40 is higher than the water in the field 39 and water still must be pumped from the field 39 into the drainage ditch 40, the tile flood pump 1 can be operated as described above to achieve this result, although the discharge end of the tile 30 may be immersed and submerged in the water of the drainage ditch 40.

It will be appreciated by those skilled in the art that the tile flood pump of this invention is characterized by convenience, portability and flexibility, in that it can be quickly and easily transported to a pumping site, attached to substantially any existing tile or drain pipe at any specific location in a levee or dike which separates a flooded field from a drainage ditch and used to drain the field. Furthermore, the tile flood pump can be powered by substantially any desired drive mechanism, including the power take-off from the tractor or by coupling the drive shaft of a diesel, or gasoline engine or an electric motor to the impeller shaft 15, typically at a universal joint 34, in conventional fashion. Moreover, the tile flood pump 1 can be optionally fitted with the pump housing flapper valve 4 and flapper valve control 24 and the pump left in place as illustrated in FIG. 1 to facilitate normal gravity drainage of water from the field 39 to the drainage ditch 40, under circumstances where the water in the field 39 is above that of the drainage ditch 40, or it can be used to pump against high water located in the drainage ditch 40, although the water level in the field 39 may be well below that of the drainage ditch 40, as described above. Furthermore, while the impeller housing 10 can be fitted with the impeller housing flanges 10*a* illustrated in the drawings, depending upon the size of the impeller housing 10, a threaded connection can be provided as an alternative design for accessing the lower impeller 13.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A pump for coupling to a drive mechanism and a pipe and pumping water from a first location through the pipe to a second location, said pump comprising a pump housing having an intake end at the first location and a connecting end adapted for coupling to the pipe; an impeller housing extending into said pump housing intermediate the ends of said pump housing; a shaft housing extending from said pump housing intermediate the ends of said pump housing, said shaft housing positioned substantially in alignment with said impeller housing; a shaft housing extension removably provided in said shaft housing; an impeller shaft journalled for rotation in said shaft housing, said shaft housing extension and said impeller housing, said impeller shaft connected to the drive mechanism and extending through said pump housing; at least one lower impeller fixed to said impeller shaft in said impeller housing; and at least one upper impeller fixed to said impeller shaft in said shaft housing extension for pumping water from the first location through said impeller housing and said pump housing and through the pipe to the second location and through said shaft housing and said shaft housing extension, responsive to operation of the drive mechanism and rotation of said impeller shaft and said lower impeller and said upper impeller.

2. The pump of claim 1 comprising a pump housing valve provided in said pump housing for controlling a flow of water through said pump housing and the pipe and a valve control mechanism connected to said pump housing valve for selectively opening and closing said pump housing valve.

3. The pump of claim 1 comprising an intake grid provided on said impeller housing for screening the water flowing from the first location into said impeller housing.

4. The pump of claim 1 comprising:

(a) a pump housing valve provided in said pump housing for controlling a flow of water through said pump housing and the pipe and a valve control mechanism connected to said pump housing valve for selectively opening and closing said pump housing valve; and (b) an intake grid provided on said impeller housing for screening the water flowing from the first location into said impeller housing.

5. The pump of claim 1 comprising a housing flange provided on said connecting end of said pump housing for engaging the pipe and removably connecting said pump housing to the pipe and impeller housing flanges provided on said impeller housing for accessing said lower impeller.

6. The pump of claim 5 comprising:

(a) a pump housing valve provided in said pump housing for controlling a flow of water through said pump housing and the pipe and a valve control mechanism connected to said pump housing valve for selectively opening and closing said pump housing valve; and (b) an intake grid provided on said impeller housing for screening the water flowing from the first location into said impeller housing.

* * * * *